US011377327B1

(12) United States Patent
Puracchio

(10) Patent No.: US 11,377,327 B1
(45) Date of Patent: Jul. 5, 2022

(54) FLEXIBLE SLING WITH DELINEATION MARKINGS

(71) Applicant: Louis E. Puracchio, Wilmington, IL (US)

(72) Inventor: Louis E. Puracchio, Wilmington, IL (US)

( * ) Notice: Subject to any disclaimer, the term of this patent is extended or adjusted under 35 U.S.C. 154(b) by 5 days.

(21) Appl. No.: 17/146,914

(22) Filed: Jan. 12, 2021

(51) Int. Cl.
*B66C 1/00* (2006.01)
*B66C 1/16* (2006.01)
*B66C 1/18* (2006.01)

(52) U.S. Cl.
CPC ..... *B66C 1/18* (2013.01)

(58) Field of Classification Search
CPC ..... B66C 1/18
USPC ..... 294/74
See application file for complete search history.

(56) References Cited

U.S. PATENT DOCUMENTS 1,168,802 A * 1/1916 Harrison ..... B66C 1/18 294/74
1,314,397 A * 8/1919 Heffron ..... B66C 1/18 294/151
2,793,903 A * 5/1957 Mallard ..... B66C 1/127 294/77
2,960,244 A * 11/1960 Strong ..... B60P 1/64 206/598
3,343,862 A * 9/1967 Holmes ..... B66C 1/18 294/81.6
3,466,080 A * 9/1969 Norton ..... D07B 1/148 73/862.56
5,056,234 A * 10/1991 Han ..... B25H 7/00 33/759
5,687,539 A 11/1997 Bond
6,050,967 A * 4/2000 Walker ..... D04B 21/18 602/76
6,510,621 B2 1/2003 Camara et al.
7,077,447 B1 * 7/2006 Betway ..... B65G 7/12 294/157
7,090,271 B2 * 8/2006 Halvorsen, Jr. ..... B65G 7/12 294/152
7,422,256 B2 9/2008 Mueller
7,938,468 B2 * 5/2011 Mueller ..... B66C 15/06 73/862.56
8,256,810 B2 * 9/2012 Mueller ..... D07B 1/145 73/862.56
10,603,458 B2 * 3/2020 Gerhardt ..... A61M 16/0057

* cited by examiner

*Primary Examiner* — Paul T Chin
(74) *Attorney, Agent, or Firm* — Kinney & Lange, P.A.

(57) ABSTRACT

A flexible sling includes two oppositely disposed attachment points defining a first end and a second end of the sling, and an elongate flexible body extending in a lateral dimension from the first end to the second end, the body having a top side and a bottom side. Each of the top side and the bottom side includes a center line marking a center of the body, a first pair of lines symmetrically disposed about the center line, a second pair of lines symmetrically disposed about the center line between the first end and the second end, and the first pair of lines, and a third pair of lines symmetrically disposed about the center line between the first end and the second end, and the second pair of lines.

20 Claims, 5 Drawing Sheets

FLEXIBLE SLING WITH DELINEATION MARKINGS

BACKGROUND

The present disclosure relates to overhead hoisting applications, and more specifically, to flexible slings for hoisting loads.

In the construction trade, flexible slings can be used to hoist and move materials. This requires great care to ensure the safety of the both the materials and the personnel on the ground. One aspect of exercising proper care is to ensure that the load is properly centered prior to hoisting. This reduces the risk of an unbalanced load breaking free from the slings. Construction materials come in many different shapes, sizes, and masses, and accordingly require different classes of sling suitable for the load. Current slings are typically only marked (via a tag, stamp, etc.) to indicate sling length and load capacity. As such, it can be an inexact and time-intensive endeavor to properly center a load prior to hoisting.

SUMMARY

A flexible sling includes two oppositely disposed attachment points defining a first end and a second end of the sling, and an elongate flexible body extending in a lateral dimension from the first end to the second end, the body having a top side and a bottom side. Each of the top side and the bottom side includes a center line marking a center of the body, a first pair of lines symmetrically disposed about the center line, a second pair of lines symmetrically disposed about the center line between the first end and the second end, and the first pair of lines, and a third pair of lines symmetrically disposed about the center line between the first end and the second end, and the second pair of lines.

A method for centering a load on a flexible sling includes laying the sling across a loading surface to expose a top side of the strap, aligning a center of gravity of the load with a first line of the sling visible on the top side, the first line being a center line of the sling, aligning a first end of the load with a second line of the sling visible on the top side, and aligning a second end of the load with a third line of the sling visible on the top side. Each of the second line and the third line are symmetrically disposed about the center line of the sling.

Figure 1:
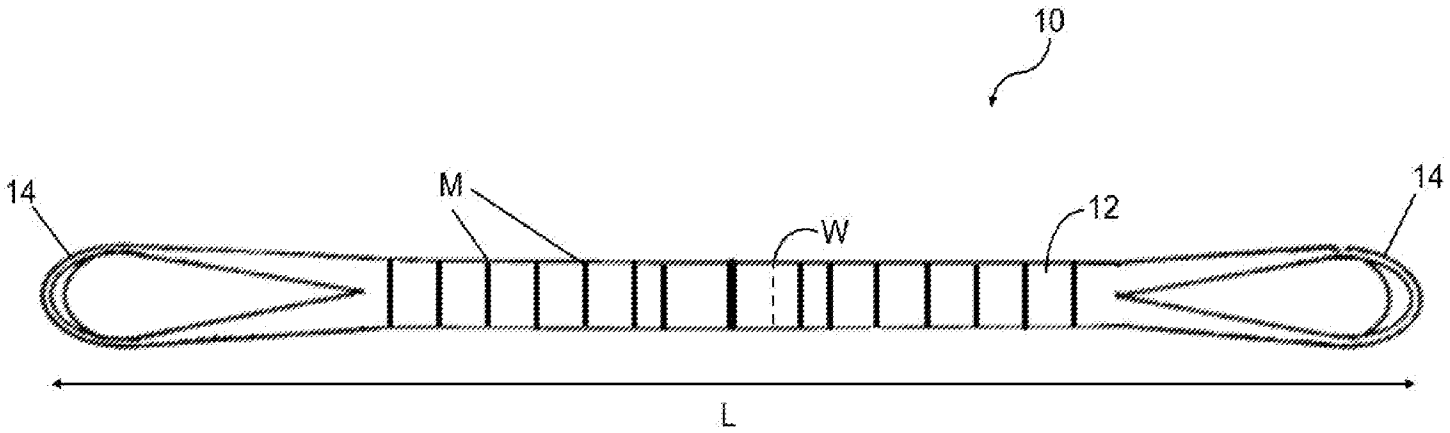
FIG. 1 is a top plan view of a delineated sling.

While the above-identified drawing figures set forth one or more embodiments of the present disclosure, other embodiments are also contemplated. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings. Like reference numerals identify similar structural elements.

DETAILED DESCRIPTION

This disclosure presents a flexible sling with means for visually centering a load prior to hoisting. The sling includes delineation markings in select increments from a marked center point to facilitate with placing a load (e.g., a pallet or other container) on the slings such that the load will be centered once the sling(s) and load are lifted from the ground. The markings can be configured as discrete lines or as larger zones in one or more colors or hatchings to provide a quick visual reference for the load riggers. As used herein, the term sling can also be used interchangeably with terms such as "strap" and "rigging."

Figure 2:
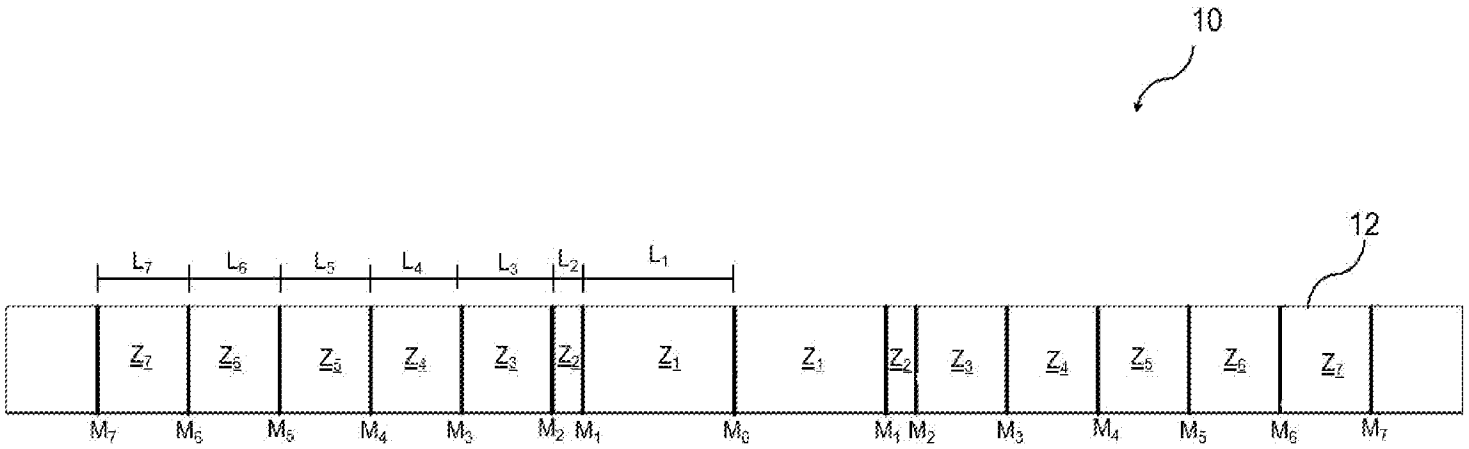
FIG. 2 is a simplified view of the body of the delineated sling according to one embodiment.

FIG. 1 is a top plan view showing sling 10. Sling 10 includes body 12 disposed between looped ends 14. Body 12 includes delineation markings (labeled collectively as M in FIG. 1). FIG. 2 is a simplified illustration of body 12 showing delineation markings M of FIG. 1 in greater detail. FIGS. 1 and 2 will be discussed together.

In an exemplary embodiment, sling 10 is a flexible web sling with a generally flat, elongate body 12 when laid out across a surface. Sling 10 can be formed from a polymer material such as nylon or polyester, but other high tensile strength fabrics suitable for hoisting loads are contemplated herein. Sling 10 can further be formed as a single ply or multi ply sling. Sling 10 has a length L which as shown, is measured from one looped end 14 to the opposing looped end 14. Sling 10 also has a width W (represented by a dashed line to distinguish from delineation markings) perpendicular to length L and is measured across body 12. Length L can, in an exemplary embodiment, be between 8 ft (2.44 m) and 16 ft (3.66 m) which are common lengths used in the construction trade. However, alternative embodiments can include lengths as low as 4 ft (1.22 m) up to 30 ft (9.14 m) to accommodate additional sizes and types of materials. Width W is generally less than length L and can range from 1 in (0.025 m) to 24 in (0.061 m) based on length L (i.e., to scale up in size) and/or based on the type of web sling (e.g., a standard elongate sling vs. a wide body cargo sling). Looped ends 14 can be configured as "eye & eye" ends formed from the same material as body 12 with a flat or twisted (with respect to body 12) orientation. Looped ends 14 can alternatively be metallic (e.g., a triangle choker configuration) or otherwise formed from a different material than body 12. Looped ends act as attachment points for securing sling 10 to a clamp, hoist, link, or the like. The load capacity of sling 10 can be affected by any of the flexible material, number of plies, length, width, eye configuration, and other factors not presented herein. Sling 10 can have a load capacity ranging from 800 lbs (362.9 kg) to over 50 tons (45, 359 kg) depending on such factors.

FIG. 2 is a detailed view of body 12 showing visual delineation markings M with looped ends 14 omitted for simplicity. As discussed herein, markings M is a collective reference to markings $M_0$-$M_7$ as are discussed below, but can generally refer to any number of markings $M_0$-$M_n$ depending on the embodiment. In the embodiment shown, markings M are discrete lines on body 12 oriented in the widthwise direction of sling 10. Center marking $M_0$ marks the center point of body 12. Typically, the center point of sling 10 will be based on its length (e.g., at 4 ft if length L is 8 ft). Moving in a laterally outward direction (i.e., toward looped ends 14), are pairs of markings $M_1$-$M_7$. As discussed herein, a pair of markings is considered to be two markings on opposing sides of and equidistance from center marking $M_0$. That is, a pair of markings is symmetrically disposed about centerline $M_0$. Markings $M_1$ represent a first pair of markings moving outward from $M_0$. In the embodiment shown, there are seven pairs of markings, each marking in a respective pair being equidistant from $M_0$ relative to the corresponding, oppositely disposed marking.

Zones $Z_1$-$Z_7$ are also shown, and can, along with zones $Z_1$-$Z_n$ in an alternative embodiment, be collectively referred to as zones Z. Zones $Z_1$-$Z_7$ represent the space between adjacent markings along body 12. For example, first zone $Z_1$ represent the region of body 12 between markings $M_0$ and $M_1$, second zone $Z_2$ represents the region of body between markings $M_1$ and $M_2$, and so on. As such, zones $Z_1$-$Z_7$ are distributed relative to center marking $M_0$ in a mirror-image fashion like pairs of markings $M_1$-$M_7$.

Each zone has a correspondingly numbered length $L_1$-$L_7$ (only labeled on one side of $M_0$) which also represents the distance between adjacent markings. In the embodiment shown, $L_1>L_2$, $L_2<L_3$, and $L_3=L_4=L_5=L_6=L_7$. More specifically, $L_1$ can be 20 in (0.51 m) such that the distance between opposing markings $M_1$ is 40 in (1.02 m). $L_2$ can be 4 in (0.101 m) such that the distance between opposing markings $M_2$ is 48 in (1.22 m). One common cargo pallet size is L 48 in×W 40 in, so markings $M_1$/zone $Z_1$ can be used (i.e., visually referenced by a rigger) to center a pallet if such a pallet is placed onto sling 10 in the widthwise direction, while markings $M_2$/zone $Z_2$ can be used if such a pallet is placed onto sling 10 in the lengthwise direction, as is discussed in greater detail below. Each of $L_3$-$L_7$ can be 12 in (0.305 m) to correspond to larger pallet/load sizes. It should be noted that alternative embodiments can include either fewer or more than seven markings and zones, depending on factors such as the length of strap 10. For example, there may be between three and ten zones and accordingly, three to ten pairs of markings M. Additionally and/or alternatively, the lengths of the zones can vary. For example, lengths $L_1$-$L_n$ can be equal, or each can differ from the previous/subsequent length. In one alternative embodiment, each of $L_1$-$L_7$ can be equal to one another and range from 8-12 in (0.203-0.304 m). Other configurations are contemplated herein.

To help quickly visually distinguish one pair of markings from another, each marking pair can be color coded. For example, markings $M_1$ and $M_2$ may be black, as their relatively different distribution from center marking $M_0$ as compared to markings $M_3$-$M_7$ is somewhat visually distinct. Each pair of markings $M_3$-$M_7$ can have a color different from markings $M_1$ and $M_2$ and also from the adjacent marking. One possible pattern could be a repeating sequence of blue-red-green such that the overall color pattern is $M_1$ (black), $M_2$ (black), $M_3$ (blue), $M_4$ (red), $M_5$ (green), $M_6$ (blue), $M_7$ (red). Alternatively, only two, or more than three colors can be used in any sequence suitable for visual identification of each pair. Suitable colors should stand out from the color of body 12 which can be a shade of yellow in an exemplary embodiment. In yet another alternative embodiment, each pair of markings can have a different line thickness than an adjacent pair and may or may not be the same color. It is important to note that only the top side T (labeled in FIG. 4) of sling 10 is visible in FIGS. 1 and 2, however, rotating sling 10 by 180° would reveal an identically delineated bottom side B (labeled in FIG. 4) such that either side can face upward (toward the pallet/load) and allow for visual load centering.

Figure 3:
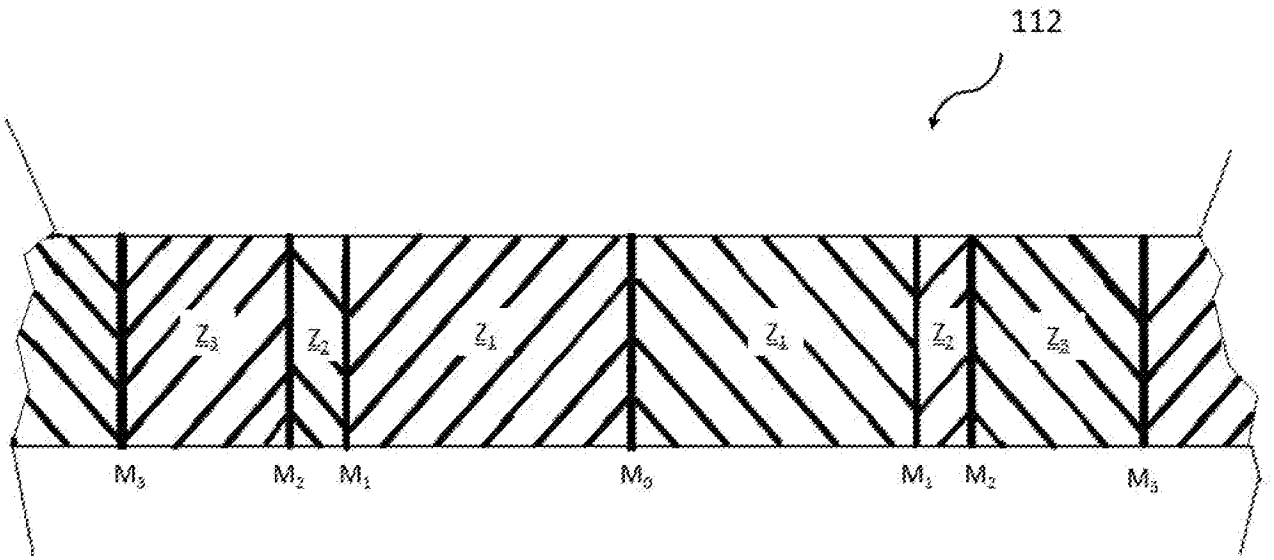
FIG. 3 is a partial view of the body of the delineated sling according to an alternative embodiment.

FIG. 3 is a partial view of body 112 showing only the first few markings M/zones Z. Body 112 is substantially similar to body 12 discussed above, except that body 112 includes hatching between neighboring markings to facilitate visual identification of the zones. As shown in FIG. 3, each zone includes herringbone-style hatching. Such hatching may be done in a single color or various colors in a pattern as was discussed with respect to body 12. Other lined or unlined patterns (e.g., stippling, fully colored zones, etc.) are contemplated herein.

In either of body 12 or body 112, markings M and zone patterns can be added to strap 12 in various ways. In an exemplary embodiment, markings M and any zone patterns can be an ink or dye applied to sling 10 using a screen-printing method (e.g., stamping, stenciling, silk screening, etc.). Alternatively, markings M and/or zone patterns can be a fabric that is stitched or woven into the flexible material of sling 10. It is further possible to use both methods, or other suitable methods not listed herein.

Figure 4:
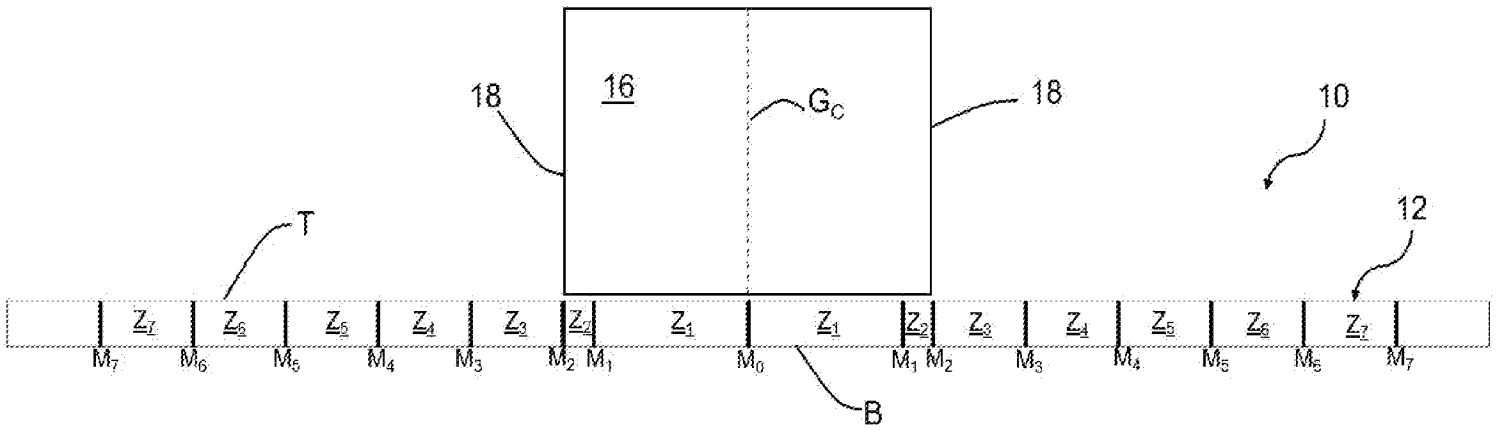
FIG. 4 is a simplified side view showing a load centered over the delineated sling.
Figure 5:
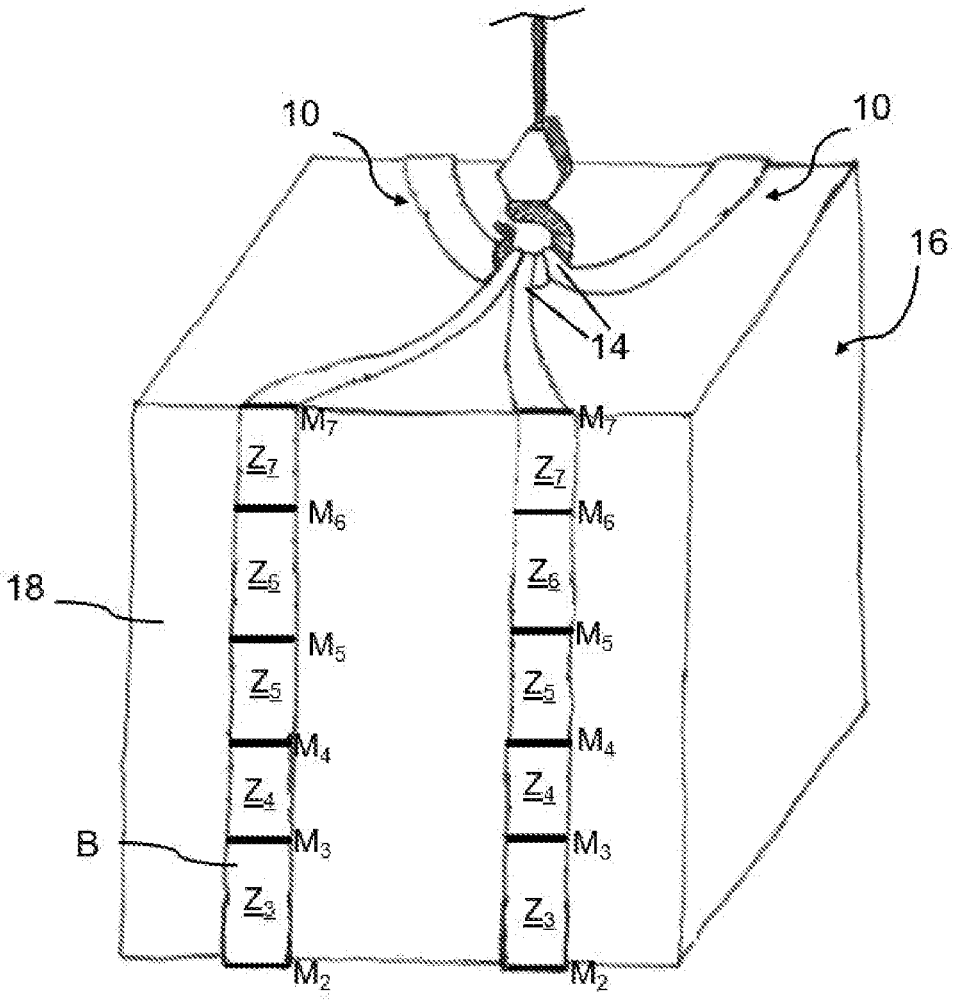
FIG. 5 is a perspective view of the load rigged with two delineated slings just prior to hoisting.

FIG. 4 is a simplified side view showing load 16 centered over body 12 of sling 10. Looped ends 14 are again omitted for simplicity. FIG. 5 is a perspective view of load 16 rigged using two slings 10 just prior to hoisting. FIGS. 4 and 5 will be discussed together. It should be noted that in markings M and zones Z are visible in the side view of FIG. 4 to facilitate visualization of the alignment of load 16 relative to body 12, but would not typically be present on the sides of body 12. Rather, markings M and/or zones Z would be present and visible on top side T and bottom side B of body 12.

Load 16 includes sides 18 and line $G_C$ which marks the center of gravity of load 16. As shown in FIG. 4, the center of gravity is aligned with center marking $M_0$ of body 12. Such alignment can help prevent issues resulting from an unbalanced load once hoisted into the air. Additionally, sides (edges) 18 align with markings pair $M_2$ which, as discussed above, can indicate a standard pallet oriented lengthwise on body 12. In practice, multiple slings 10 can be used for safely hoisting load 16. To prepare load 16 for hoisting, a rigger can lay out the slings 10 to be used on a loading surface (e.g., the ground). Load 16 can be positioned such that its center of gravity, which is some cases is its true center, is aligned with marking $M_0$ of each sling 10. If desired, the rigger can additionally or alternatively use a pair of markings (e.g., $M_2$) to position load 16. Once positioned, slings 10 can be pulled up along sides 18 in order to attach looped ends 14 to a hoisting device. As can be seen in FIG. 5, bottom side B of slings 10 becomes visible once lifted up along sides 18, and the rigger can further visualize that load 16 is positioned as desired by referencing the identical delineations markings bottom side B. In an alternative embodiment, one sling 10 can be disposed perpendicular to and cross the other sling 10, depending on the load 16 and/or loading protocols.

Sling 10 can alternatively have a variety of configurations not discussed above, such as a braided body and/or looped ends, or an endless (ring-like) configuration. Additionally, markings M/zones Z can be printed onto a sleeve or cover which is fitted over an unmarked flexible sling. The sleeve could be removable attached to the underlying sling using snaps, buttons, or other suitable attachment means.

The disclosed sling allows for easy visualization of load placement to help ensure proper balance prior to hoisting. Although discussed with respect to the construction trade, the disclosed sling can generally be used in material-handling environments such as warehouses, shipyards, or other industrial settings.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A flexible sling comprising:

two oppositely disposed attachment points defining a first end and a second end of the sling;

an elongate flexible body extending in a lateral dimension from the first end to the second end, the body having a top side and a bottom side, each of the top side and the bottom side comprising:

a center line marking a center of the body;

a first pair of lines symmetrically disposed about the center line;

a second pair of lines symmetrically disposed about the center line between the first end and the second end, and the first pair of lines; and a third pair of lines symmetrically disposed about the center line between the first end and the second end, and the second pair of lines.

2. The sling of claim 1, wherein a first distance between the center line and one line of the first pair of lines is greater than a second distance between the one line of the first pair of lines and an adjacent line of the second pair of lines.

3. The sling of claim 2, wherein a third distance between the one line of the second pair of lines and an adjacent line of the third pair of lines is greater than the second distance.

4. The sling of claim 3, wherein the first distance is 20 in and the second distance is 4 in.

5. The sling of claim 4, wherein the third distance is 12 in.

6. The sling of claim 3 and further comprising:

a fourth pair of lines symmetrically disposed about the center line between the first end and the second end, and the third pair of lines; and a fifth pair of lines symmetrically disposed about the center line between the first end and the second end, and the fourth pair of lines.

7. The sling of claim 6, wherein a fourth distance between the one line of the third pair of lines and an adjacent line of the fourth pair of lines is equal to the third distance.

8. The sling of claim 6 and further comprising:

a sixth pair of lines symmetrically disposed about the center line between the first end and the second end, and the fifth pair of lines; and a seventh pair of lines symmetrically disposed about the center line between the first end and the second end, and the sixth pair of lines.

9. The sling of claim 3, wherein the first pair of lines has a first color, the second pair of lines has a second color, and the third pair of lines has a third color.

10. The sling of claim 9, wherein the third color is different from one of the first color and the second color.

11. The sling of claim 3, wherein the body comprises a first hatching pattern between the center line and the one line of the first pair of lines.

12. The sling of claim 11, wherein the body comprises a second hatching pattern between the one line of the first pair of lines and the one line of the second pair of lines.

13. The sling of claim 12, wherein the first hatching pattern is different from the second hatching pattern.

14. The sling of claim 3, wherein the center line, the first pair of lines, the second pair of lines, and the third pair of lines are each disposed across the body in a widthwise direction.

15. The sling of claim 3, wherein the center line, the first pair of lines, the second pair of lines, and the third pair of lines are formed from an ink applied to the body.

16. The sling of claim 3, wherein the center line, the first pair of lines, the second pair of lines, and the third pair of lines are formed from a fabric and are stitched into the body.

17. The sling of claim 3, wherein the sling has a length, and wherein the length ranges from 4 ft. to 30 ft.

18. The sling of claim 17, wherein the length ranges from 8 ft. to 16 ft.

19. The sling of claim 3, wherein the first end and the second end comprise loops.

20. A method for centering a load on the flexible sling of claim 1, the method comprising:

laying the sling across a loading surface to expose a top side of the strap;

aligning a center of gravity of the load with a first line of the sling visible on the top side, the first line being a center line of the sling;

aligning a first end of the load with a second line of the sling visible on the top side; and aligning a second end of the load with a third line of the sling visible on the top side;

wherein the each of the second line and the third line are symmetrically disposed about the center line of the sling.

* * * * *